US011852992B2

(12) United States Patent
Triplett et al.

(10) Patent No.: US 11,852,992 B2
(45) **Date of Patent: *Dec. 26, 2023**

(54) REUSABLE MEDIA PACKAGING FOR IMAGING DEVICE

(71) Applicant: LEXMARK INTERNATIONAL, INC., Lexington, KY (US)

(72) Inventors: Edward Lynn Triplett, Lexington, KY (US); Kevin Dean Schoedinger, Lexington, KY (US); Todd Allison Quinn, Carlisle, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/103,009

(22) Filed: Jan. 30, 2023

(65) Prior Publication Data

US 2023/0176504 A1 Jun. 8, 2023

Related U.S. Application Data

(63) Continuation of application No. 17/696,950, filed on Mar. 17, 2022, now Pat. No. 11,675,290.

(60) Provisional application No. 63/162,198, filed on Mar. 17, 2021.

(51) Int. Cl.

| | |
|---|---|
| ***G03G 15/00*** | (2006.01) |
| ***G03G 21/16*** | (2006.01) |
| ***G03G 15/08*** | (2006.01) |
| ***G03G 21/12*** | (2006.01) |
| ***B65H 1/02*** | (2006.01) |
| ***B65H 1/26*** | (2006.01) |

(52) U.S. Cl.

CPC ..... *G03G 15/0894* (2013.01); *B65H 1/027* (2013.01); *B65H 1/266* (2013.01); *G03G 15/0875* (2013.01); *G03G 15/6502* (2013.01); *G03G 21/12* (2013.01); *G03G 21/1647* (2013.01); *G03G 21/1676* (2013.01); *B65H 2405/31* (2013.01); *G03G 2215/0097* (2013.01); *G03G 2215/00383* (2013.01)

(58) Field of Classification Search

CPC ..... G03G 15/0875; G03G 15/0894; G03G 15/6502; G03G 21/12; G03G 21/1647; G03G 21/1676; G03G 2215/00383; G03G 2215/0097; B65H 1/00; B65H 1/027; B65H 1/266; B65H 2402/44; B65H 2405/20; B65H 2405/31; B65H 2801/06

See application file for complete search history.

(56) References Cited

U.S. PATENT DOCUMENTS

2016/0264367 A1* 9/2016 Mizuguchi

* cited by examiner

*Primary Examiner* — Sophia S Chen

(57) ABSTRACT

A reusable media shell has a frame to hold sheets of media in an interior. A removable cap connects to the frame and its manipulation unveils the media for picking by an imaging device. The cap resides on a terminal end of the frame so the frame covers a majority of the media. A lift plate in the interior forces upward the sheets for picking. Two magnets on the frame magnetically secure the frame to magnets in a base of the imaging device and position the sheets in the base. Upstanding walls, a lid and bottom define the interior of the frame. Inserts attached to the walls allow adjustment to accommodate various sizes of the media.

20 Claims, 8 Drawing Sheets

REUSABLE MEDIA PACKAGING FOR IMAGING DEVICE

This utility application claims priority as a continuation of U.S. patent application Ser. No. 17/696,950, filed Mar. 17, 2022, in turn claiming priority to U.S. Provisional Application Ser. No. 63/162,198, filed Mar. 17, 2021.

FIELD OF THE INVENTION

The present disclosure relates to packaging to hold sheets of media for an imaging device, such as a printer or copier. It relates further to a reusable, durable shell for the media. Ease of installation of the shell into the imaging device and proper positioning are further considerations.

BACKGROUND

Traditional methods of printing documents require tearing open paper packaging materials, removing media, and inserting the media into a paper tray of an imaging device. The imaging then device picks individual sheets of the media from the tray as needed to print individual, hard-copy documents. Users replenish the media when the media becomes low or empty in the tray. Users discard the entirety of the packaging materials. Sometimes the packaging materials are recycled. In contrast, the inventors contemplate wholly different methods and arrangements for media packaging as described herein.

SUMMARY

A reusable media shell has a frame to hold sheets of media in an interior. A removable cap connects to the frame and its manipulation unveils the media for picking by an imaging device. The cap resides on a terminal end of the frame so the frame covers a majority of the media. A lift plate in the interior forces upward the sheets for picking. Two magnets on the frame magnetically secure the frame to magnets in a base of the imaging device and position the sheets in the base. Upstanding walls, a lid and bottom define the interior of the frame. Inserts attached to the walls to allow adjustment to accommodate various sizes of the media. Alternate embodiments are also contemplated.

DETAILED DESCRIPTION

In the following detailed description, reference is made to the accompanying drawings where like numerals represent like details. The embodiments are described in sufficient detail to enable those skilled in the art to practice the invention. It is to be understood that other embodiments may be utilized and that changes may be made without departing from the scope of the invention. The following detailed description, therefore, is not to be taken in a limiting sense and the scope of the invention is defined only by the appended claims and their equivalents. In accordance with the features of the invention, a reusable media shell is described for use with an imaging device.

Figure 1:
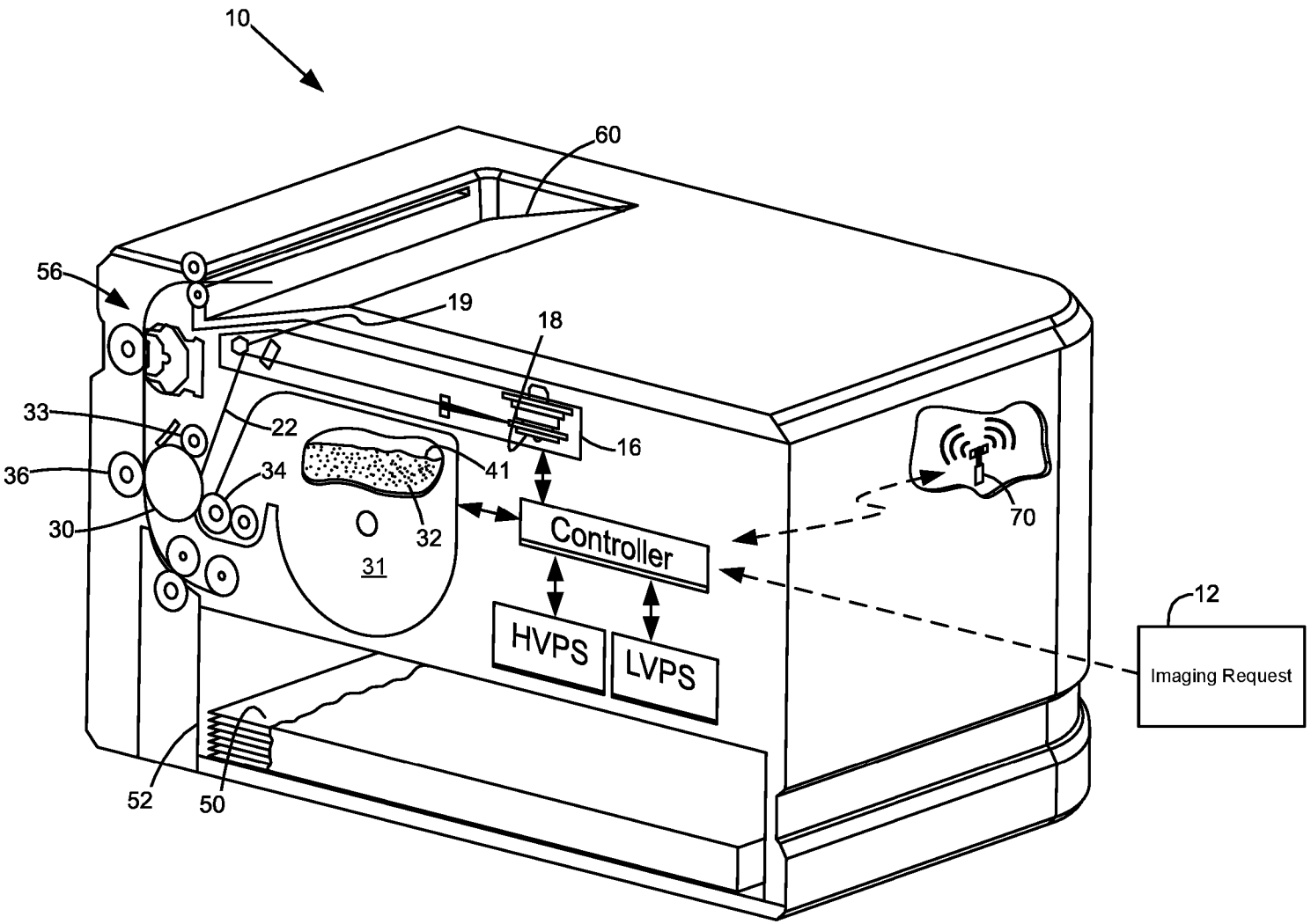
FIG. 1 is a diagrammatic view of an imaging device for imaging documents, including an internal schematic view revealing various architectural components facilitating the electrophotographic imaging of sheets of media.

FIG. 1 teaches an imaging device 10 for imaging documents. The device is described as an electrophotographic printer having a supply of toner, but could be an inkjet printer, copier, fax machine, all-in-one, or other similar device having supplies of ink and/or toner. It is also described as monochromatic, e.g., black only (shown), but could be color-imaging capable (not shown). In any, the device receives at a controller an imaging request 12 for imaging media 50. The controller typifies an ASIC(s), circuit (s), microprocessor(s), firmware, software, or the like. The request comes from external to the imaging device, such as from a computer, laptop, smart phone, cloud service, etc. The controller converts the request to appropriate signals for providing to a laser scan unit (LSU) 16. The unit turns on and off a laser 18 according to pixels of the imaging request. A rotating mirror 19 and associated lenses, reflectors, etc. focus a laser beam 22 onto a photoconductive (PC) drum 30. The drum corresponds to a supply item 31 of toner 32. A charge roll 33 sets a charge on a surface of the drum 30 as the drum rotates. The laser beam 22 electrostatically discharges the drum to create a latent image. A developer roll 34 introduces toner from the supply 32 to the latent image and such is electrostatically attracted to create a toned image on a surface of the drum. A voltage differential between the surface of the drum 30 and an opposed transfer roll 36 transfers the toned image direct from the drum to a sheet of media 50 passing between the drum and transfer roll or indirect to an intermediate transfer member (not shown) for subsequent transfer to the media. The sheet advances from a reusable media shell 52 to a fuser assembly 56 to fix the toned image to the media through application of heat and pressure. Users pick up the media from a bin 60 after it advances out of the imaging device. The controller coordinates the operational conditions facilitating the timing of the image transfer and transportation of the media from shell to output bin. The controller also coordinates with one or more high and low voltage power supplies (HVPS, LVPS) to set the relative voltages for the electrophotgraphic image process, including setting the voltages for the charge roll 33, the developer roll 34 and transfer roll 36.

The imaging device optionally also includes an antenna 70. The antenna is tuned to operate in a cellular network. The antenna coordinates with the controller. The controller assesses a level 41 of toner in the supply 32 and broadcasts the toner level over the antenna. Similarly, the controller counts sheets of media 50 imaged in the imaging device. The number is broadcast or accessed by the antenna over the cellular network.

Figure 2:
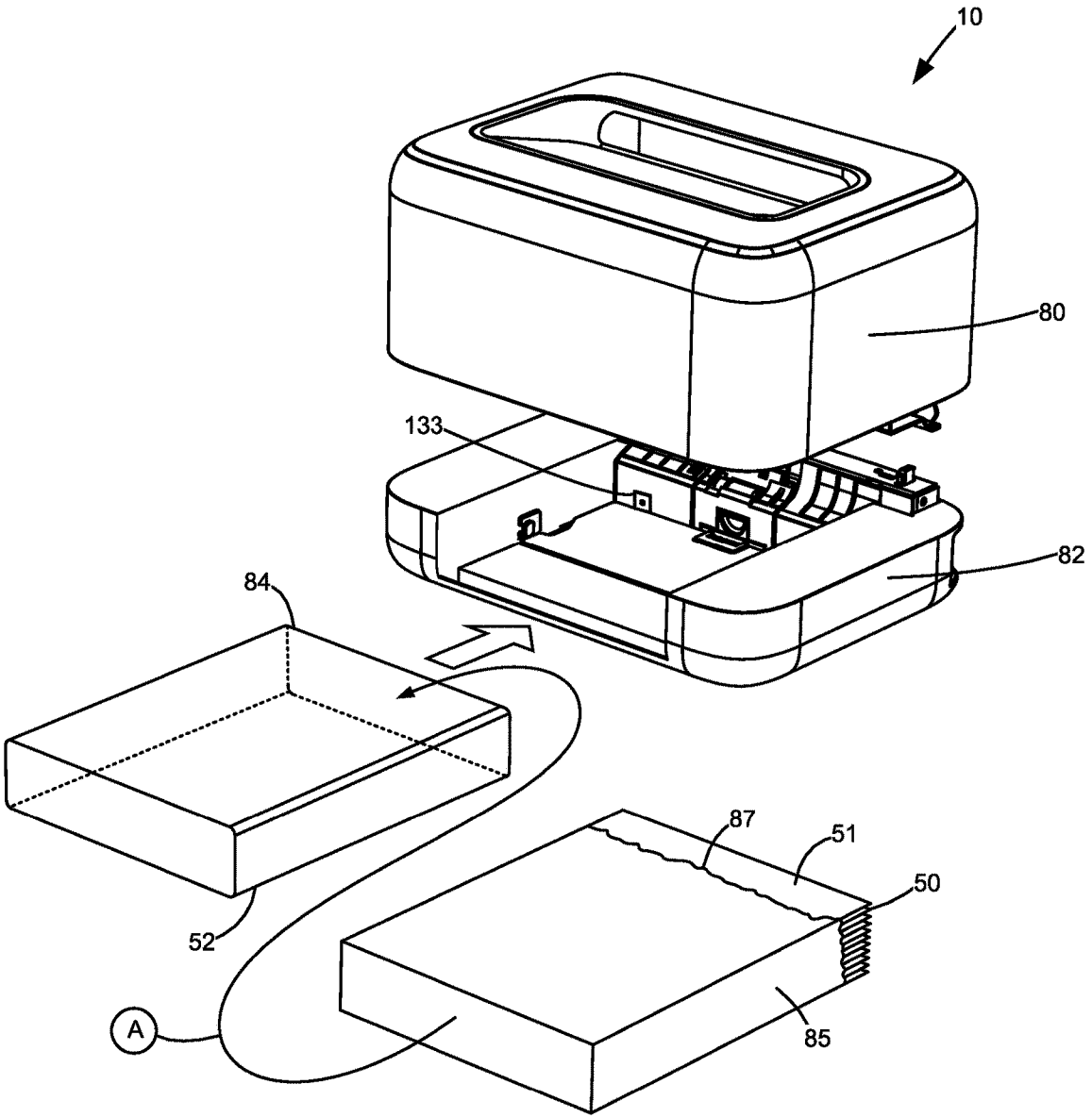
FIG. 2 is an exploded view of a representative imaging device indicating its modularity and media usage.

That the imaging device in one embodiment is a minimally viable imaging device, there exists no vents, no fans, no user adjustments, no user interface, no special settings for installation. There also exists a very short paper path length from the shell 52 to output bin 60. As seen in FIG. 2, the imaging device may also include a modular assembly with stackable components 80 (engine), 82 (base) into which the shell 52 inserts. In turn, media sheets fit into the shell and can remain in their packaging materials 85. They need be only exposed at terminal end 84 of the shell where they can be picked by the imaging device. A perforation, pull tab, or other can be provided to facilitate exposure of the media. Tearing off or opening an end 87 of the materials 85 exposes the media at 51, but not an entirety of the packaging materials is removed from the media. Rather, most of the packaging materials remain about the media and only the end 84 of the media is made available for picking by the imaging device. By following arrow "A," artisans will understand how the media and packaging materials are inserted into the shell. That is, the unopened end of the packaging materials inserts first into the shell and the open end 87 inserts second and interfaces with modular component 82. The shell fits a variety of sizes of media, such as 8.5"×11" letter paper size or 8.5"×14" legal paper size, etc. In any, the shell is sized and shaped as a rectangular solid to mimic the size and shape of the packaging materials of the media, but also has a size revealing access of the media to the imaging device. The packaging materials and the media are preferably recycled paper products. Whereas the materials for the shell, as well as the materials for the imaging device, are preferably reusable plastics, where possible, and flame-retardant materials. In an alternate embodiment (FIG. 3), the sheets of media 50 are pre-loaded or inserted into the shell 52 without having been first packaged in packaging materials 85.

In any embodiment, media usage of the imaging device is monitored over a cellular network as noted in FIG. 1. The monitoring occurs according to predefined time schedules, e.g., weekly, daily, etc., or randomly, or other. Upon the sheets of media reaching less than a predetermined number of sheets, users can be notified to replenish the sheets in a shell or replace the shell with another shell having media therein. Weight and/or volume monitoring of the media in the shell is also contemplated.

Figure 4:
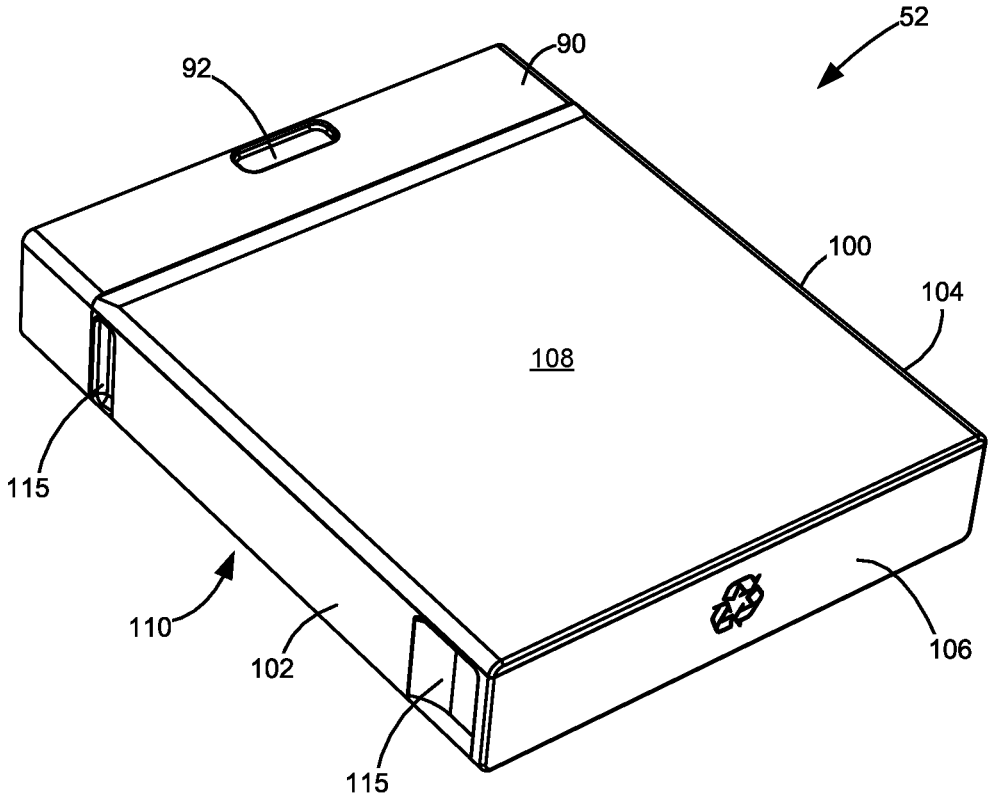
FIG. 4 is a diagrammatic view of a medial shell, including a removable cap protecting the contents of the shell, a finger grip on the cap activates the removal of the cap.
Figure 5:
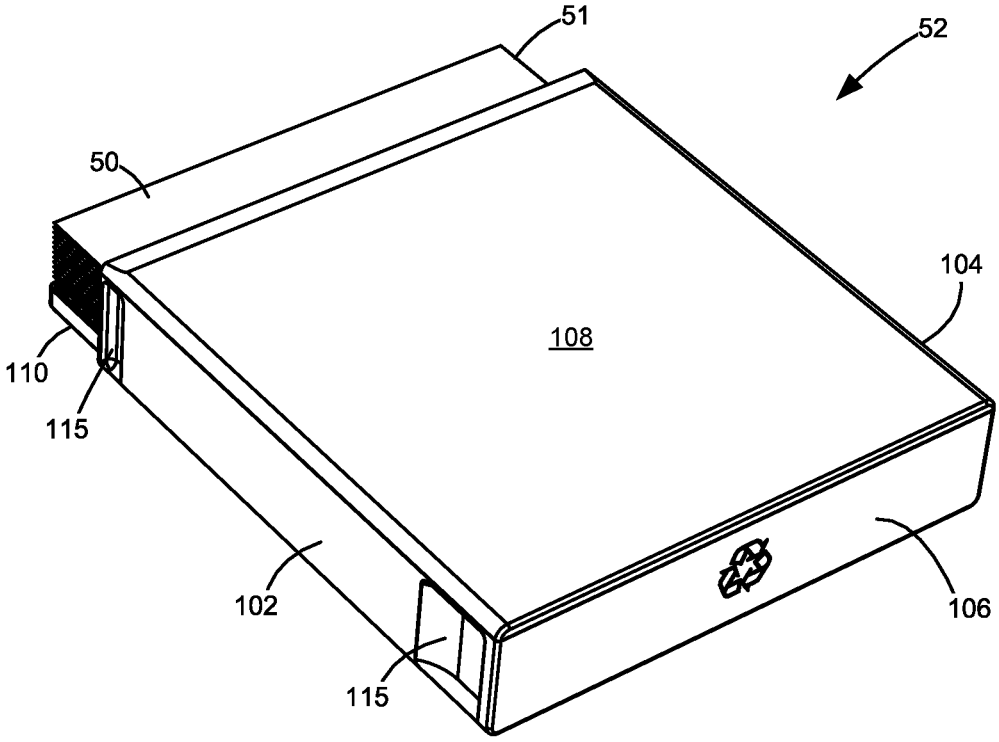
FIG. 5 is a diagrammatic view of a media shell, having its cap removed unveiling the media in the interior of the shell, the interior being defined by pluralities of walls of a frame.

With reference to FIG. 4, one embodiment of a shell 52 includes a removable cap 90 that snap fits to a frame 100 of the shell, the frame being defined by walls. The walls typify left and right upstanding side walls 102, 104 and a back or base wall 106. A lid and bottom 108, 110 on the walls, from above and below the walls, combine to define the frame and an interior 120 (FIG. 6) of the frame that contains the media 50. Users manipulate a finger grip 92 on the cap to reveal the contents of the interior and expose the media for picking by the imaging device. The finger grip is depressed and slid away from the frame to detach the cap from the frame before use. As best seen in FIG. 5, once the cap is removed from the frame, the media 50 is exposed at 51, but artisans will appreciate that the frame remains covering a majority of the media. Artisans will also note a length of the bottom 110 extends further than a length of the lid 108. In this way, the length of the media is fully supported by the bottom 110, while the lid 108 is partially removed to unveil a top surface of the media for picking. In alternate embodiments, additional or other finger grips may be placed that users manipulate to remove the cap from the frame. Detents 115 or similar other devices may be placed on the frame to help in removing the cap and/or assisting users in inserting/removing the shell 52 from the imaging device.

Figure 3:
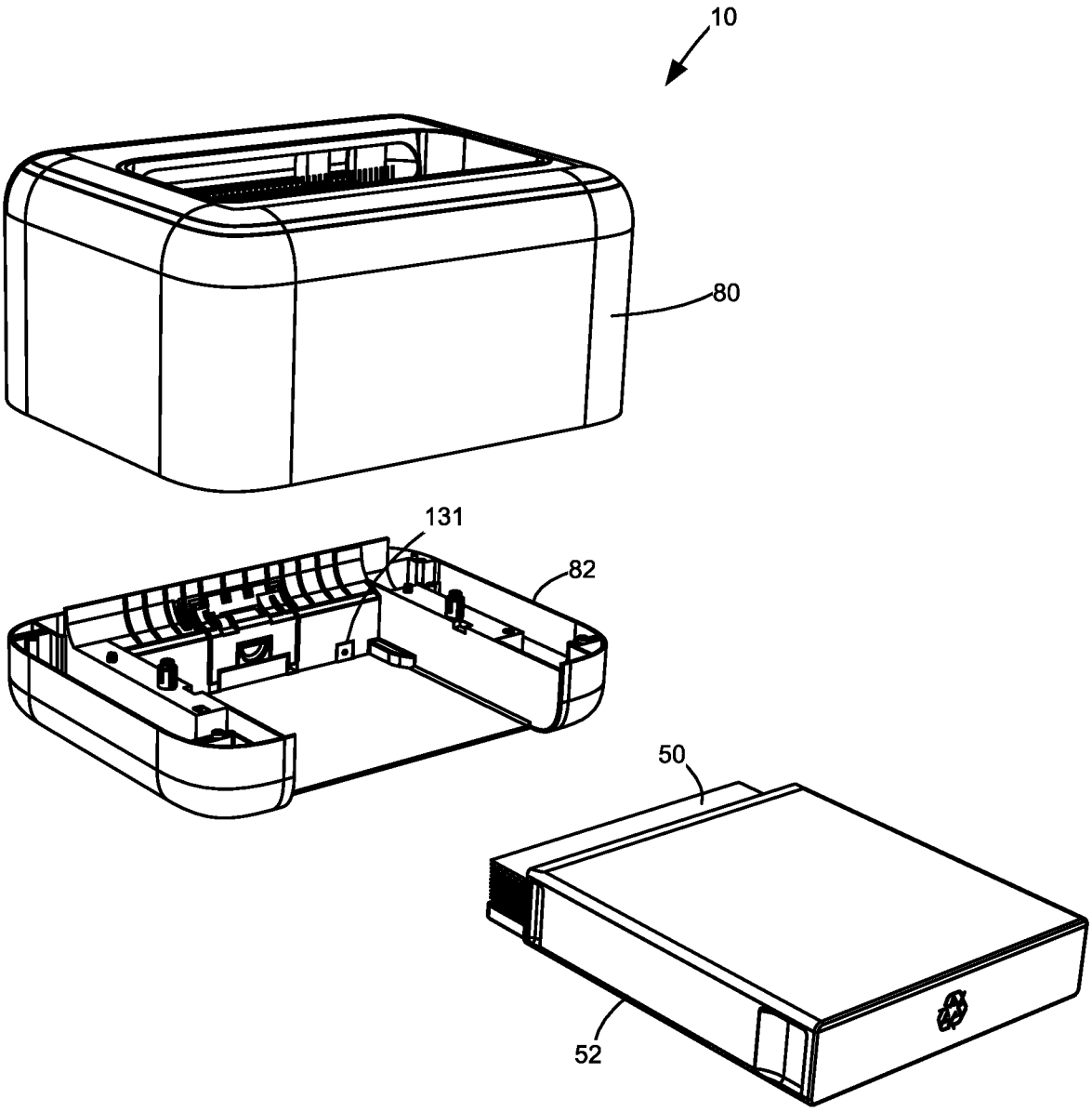
FIG. 3 is a diagrammatic view of a representative imaging device indicating a media shell loaded with media for imaging, including positional magnets of the imaging device for magnetic connection to the media shell.
Figure 6:
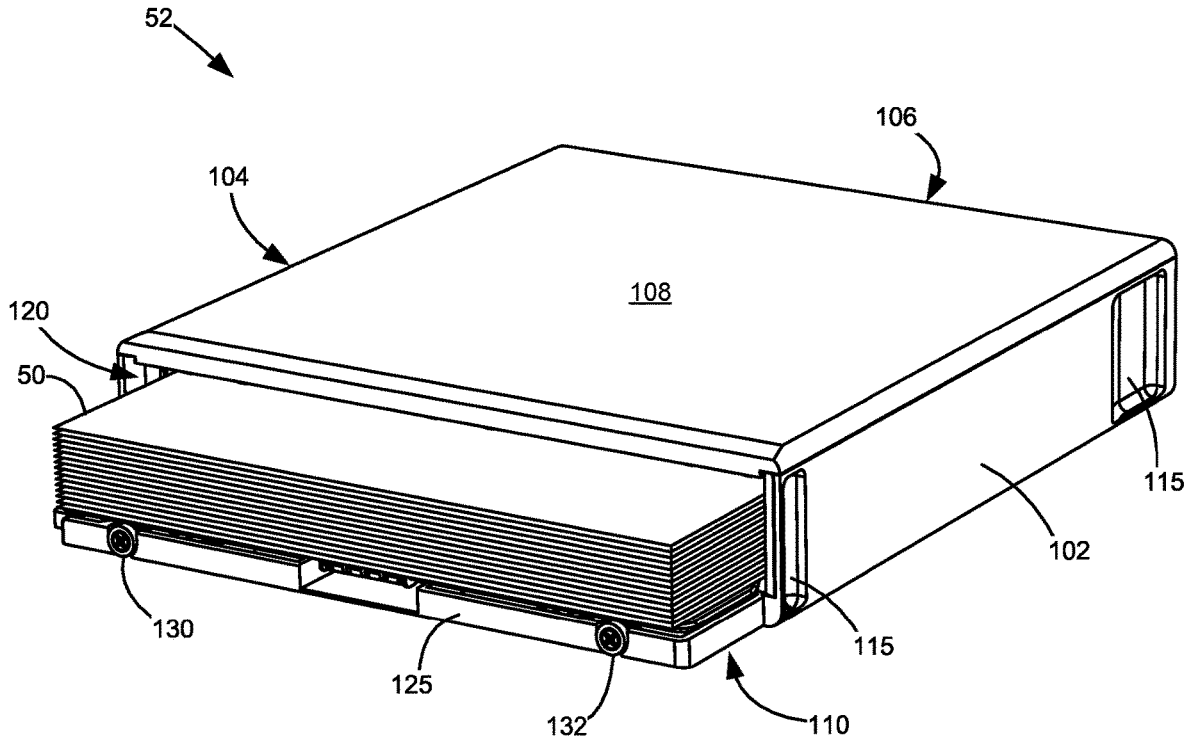
FIG. 6 is a diagrammatic view of a media shell, including positional magnets along a leading edge of a frame.

In FIG. 6, along a leading edge 125 of the shell 52, there exists one or more magnets 130, 132 that serve to magnetically secure the frame to the imaging device during use to position the media for picking by a roller of the imaging device. As seen in FIGS. 2 and 3, the magnets of the frame mate with corresponding opposite-polarity magnets 131, 133 of the imaging device. Of course, other magnets and placement on the frame and imaging device are contemplated.

Figure 7:
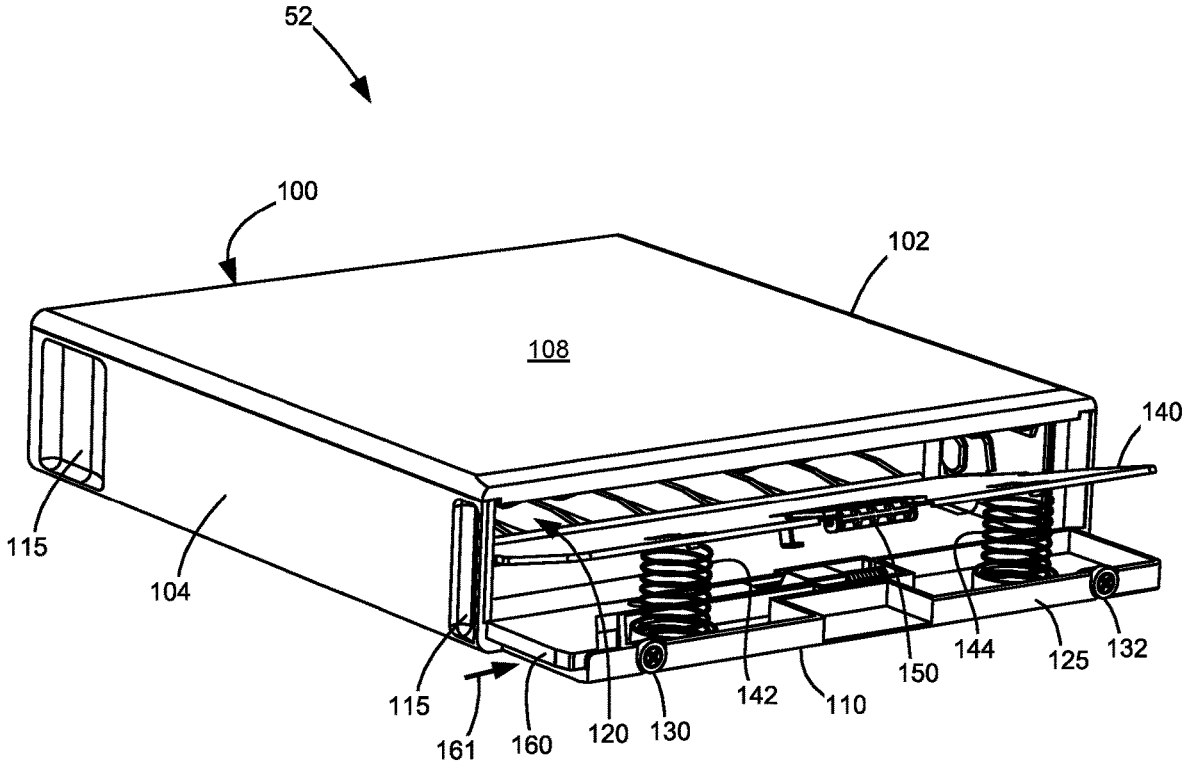
FIG. 7 is a diagrammatic view of a media shell, without sheets of media, including a lift plate, springs therefor, an actuator therefor, and an idler roller.
Figure 8:
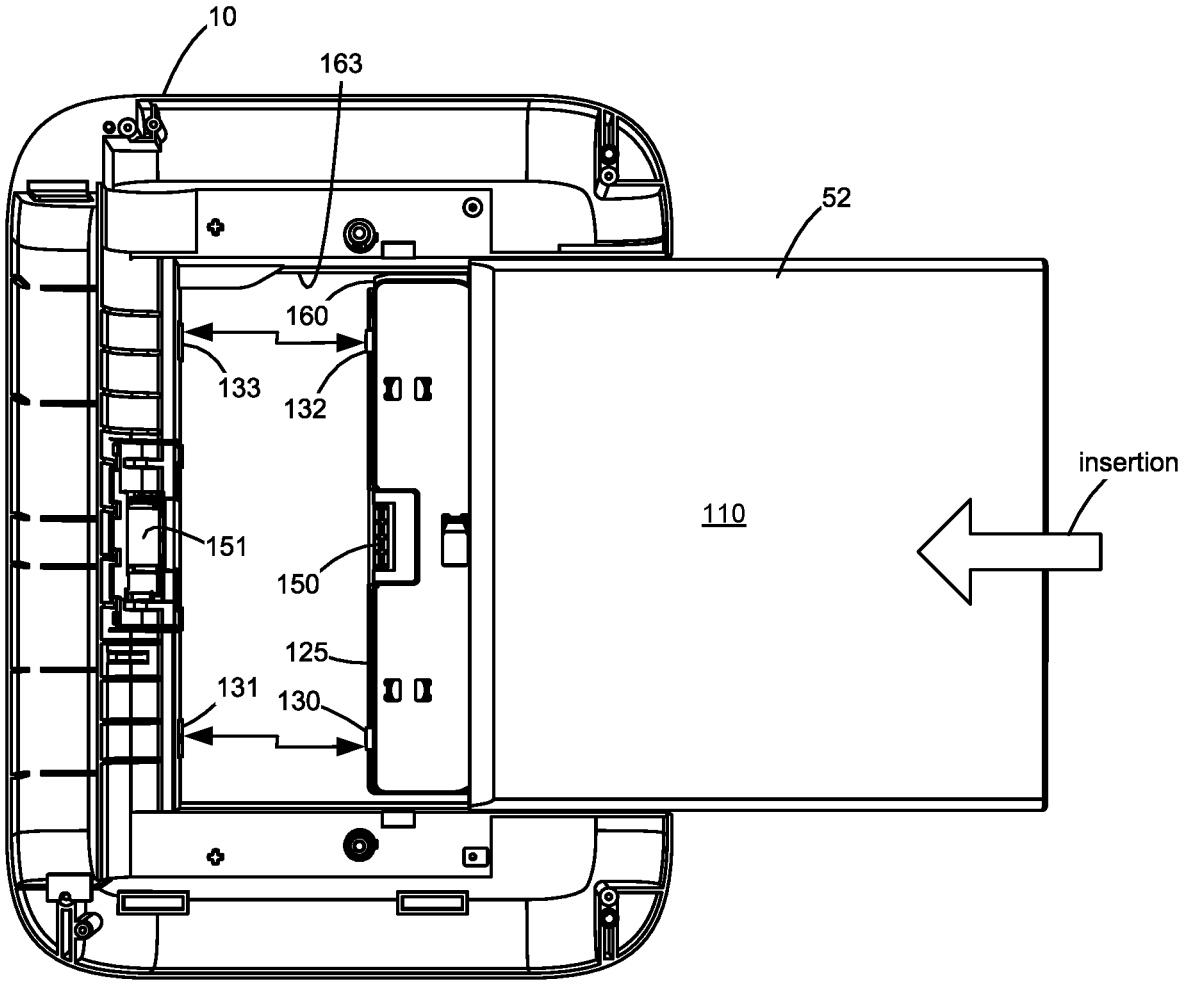
FIG. 8 is a diagrammatic view from a bottom of the imaging device and media shell showing movement of the shell for positional insertion into the imaging device, including actuation of the actuator of the lift plate and alignment of magnets between the shell and imaging device.

With reference to FIG. 7, a shell 52 (having an empty interior 120 devoid of media for ease of illustration) is shown to note a lift plate 140 residing underneath where the media would reside in the interior. The lift plate 140 raises upward the media in the interior 120 in a direction from the bottom 110 to the lid 108 to keep media in contact with the pick roller of the imaging device during use. One or more springs 142, 144, are provided underneath the lift plate to bias upward the lift plate 140. An idler roller 150 further accompanies the lift plate 140 and assists in feeding media from the shell 52 to the imaging device. Also, an actuator link 160 is provided with the frame so that upon activation (movement in the direction of 161, in this example), the lift plate 140 is released from a secured position to bias upward the media on the lift plate. As seen in FIG. 8, in a bottom view showing an insertion direction (insertion arrow) of the shell 52 into the imaging device 10, a sidewall 163 of the imaging device causes the actuation of the actuator link 160 by way of compressing the actuator link against the sidewall. Of course, other actuation mechanisms are readily envisioned as are other methods of actuating the mechanisms. Also noted in FIG. 8 are the relative alignments and mating of the magnets 130, 132 of the shell 52 and the magnets 131, 133 of the imaging device. The pick roller of the imaging device is noted at 151 and corresponds to the location (centrally located in this case) to the idler roll 150 of the lift plate.

Figure 9:
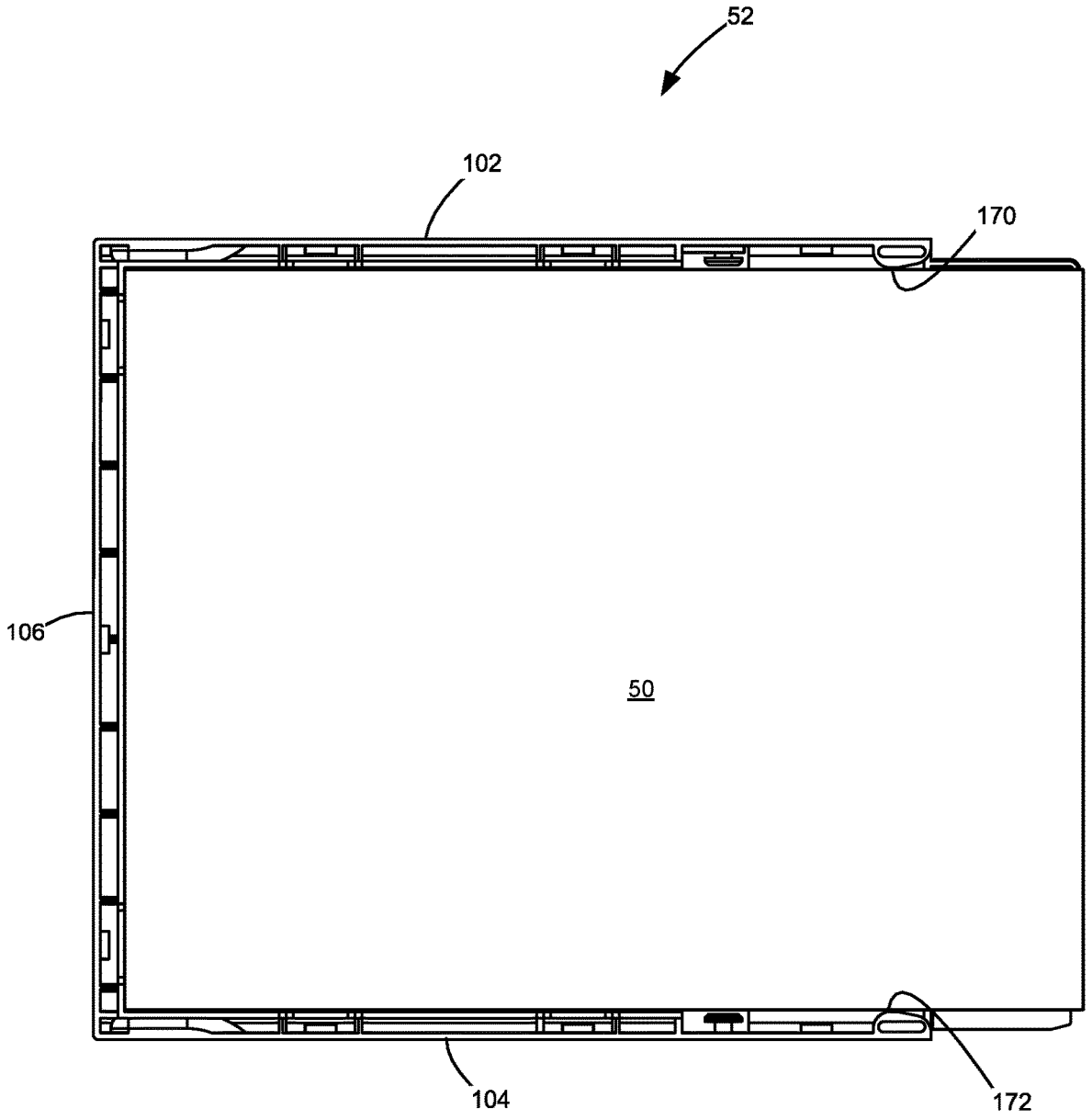
FIG. 9 is a diagrammatic view of a partial interior of the media shell showing inserts to accommodate various sizes of sheets of media.

With reference to FIG. 9, a partial view of the interior of the shell 52 is provided. One or more inserts 170, 172 are connected to the walls 102, 104 of the frame. They serve to adjust a size of the interior to accommodate various sizes of media 50.

The foregoing illustrates various aspects of the present disclosure. It is not intended to be exhaustive. Rather, it is chosen to describe the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A reusable media shell, comprising:

a frame having an interior to hold media;

a removable cap connected to the frame, whereby removal of the cap reveals the media in the interior of the frame but the frame covers a majority of the media;

one or more magnets on the frame to magnetically secure the frame to an imaging device during use to position the media for picking by a roller of the imaging device; and a lift plate in the interior of the frame residing underneath the media, the lift plate including an idler roller.

2. The reusable media shell of claim 1, wherein the cap connects to the frame by snap fitting.

3. The reusable media shell of claim 1, wherein the cap includes a finger grip for users to depress and slide to detach the cap from the frame before use.

4. The reusable media shell of claim 1, wherein the one or more magnets comprises two magnets along a leading edge of the frame underneath the media.

5. The reusable media shell of claim 1, further including a plurality of springs underneath the lift plate to biases upward the media as oriented during use.

6. The reusable media shell of claim 1, further including an actuator link to release the lift plate to lift upward the media upon the frame being inserted into the imaging device.

7. The reusable media shell of claim 6, wherein the actuator link is compressed upon being actuated by an actuator of the imaging devices that moves the actuator link.

8. The reusable media shell of claim 7, wherein the actuator link is compressed against a sidewall of the imaging device.

9. The reusable media shell of claim 1, further including a plurality of inserts in the interior of the frame to adjust the interior for various sizes of the media.

10. A reusable media shell, comprising:

a frame having an interior containing media, a plurality of walls defining the interior;

a removable cap connected to the frame, whereby removal of the cap reveals the media in the interior of the frame;

a lift plate secured in the interior of the frame residing underneath the media; and an actuator link to release the lift plate to lift upward the media upon the frame being inserted into an imaging device.

11. The reusable media shell of claim 10, further including an idler roller on the lift plate.

12. The reusable media shell of claim 11, wherein the idler roller resides along a leading edge of the lift plate as oriented during use in a direction of insertion of the frame into the imaging device.

13. The reusable media shell of claim 10, further including two magnets on the frame to magnetically secure the frame to the imaging device during use to position the media for picking by a roller of the imaging device.

14. The reusable media shell of claim 10, wherein the plurality of walls includes two side walls and a base wall, further including a lid and bottom connected to each of the two side walls and the base wall, the bottom extending further in length than the lid.

15. The reusable media shell of claim 10, further including a plurality of springs underneath the lift plate to biases upward the media as oriented during use.

16. The reusable media shell of claim 10, wherein the cap connects to the frame by snap fitting.

17. The reusable media shell of claim 16, wherein the cap includes a finger grip for users to depress and slide to detach the cap from the frame before use.

18. The reusable media shell of claim 10, wherein the actuator link is compressed upon being actuated by an actuator of the imaging devices that moves the actuator link.

19. The reusable media shell of claim 18, wherein the actuator link is compressed against a sidewall of the imaging device.

20. An imaging device, comprising:

a sidewall;

a pick roller for picking sheets of media;

a base having at least two magnets; and a reusable media shell, the shell having a frame having an interior to hold the sheets of media, a removable cap connected to the frame, whereby removal of the cap reveals the sheets of media in the interior of the frame but the frame covers a majority of the sheets of media, two magnets on the frame to magnetically secure the frame to the at least two magnets of the base to position the media for picking by the pick roller, a lift plate secured in the interior of the frame residing underneath the media, wherein a plurality of springs reside underneath the lift plate, and an actuator link to release the lift plate for the springs to bias upward the media upon the frame being inserted into the imaging device and being compressed by the sidewall.

* * * * *